US005667375A

United States Patent [19]

Sebastiani

[11] Patent Number: 5,667,375

[45] Date of Patent: Sep. 16, 1997

[54] GAS COMBUSTION APPARATUS AND METHOD FOR CONTROLLING THE SAME

[76] Inventor: Enrico Sebastiani, Via S. Banfi, 13-20025 Legnano—Milan, Italy

[21] Appl. No.: 199,105

[22] Filed: Feb. 22, 1994

[30] Foreign Application Priority Data

Aug. 16, 1993 [EP] European Pat. Off. ..... 93113075

[51] Int. Cl.[6] ..... F23N 5/02

[52] U.S. Cl. ..... 431/12; 431/354; 431/75; 126/116 A

[58] Field of Search ..... 236/15 B; 431/12, 431/62, 63, 75, 89, 90, 354; 126/39 E, 116 A

[56] References Cited

U.S. PATENT DOCUMENTS

| | | | |
|---|---|---|---|
| 1,981,602 | 11/1934 | Levey et al. | 431/90 |
| 2,842,076 | 7/1958 | Martin . | |
| 4,465,456 | 8/1984 | Hynek et al. | 431/90 X |
| 4,499,890 | 2/1985 | Meulenbrug | 431/354 X |

FOREIGN PATENT DOCUMENTS

| | | | |
|---|---|---|---|
| 2631 718 | 2/1977 | Germany . | |
| 3918-855 | 8/1990 | Germany . | |
| 4207-814 | 9/1992 | Germany . | |
| 403473 | 12/1933 | United Kingdom | 431/90 |
| 1499 091 | 1/1978 | United Kingdom . | |
| 2242514 | 2/1991 | United Kingdom | 431/354 |

OTHER PUBLICATIONS

Gas Combustion Heat, Skunca 1973.

Butterfly Wing Shaped Flame Technology, Vannoni et al 1995.

Low Nox Butterfly Wing Shaped Flame, Worgas Briciatori S.R.L. 1995.

Explaination of the Blowoff of Inverted Flames by Area–Increase Concept, Kawamura et al 1979.

Gas Combustion Heat, Gas–Ergas, 136 Nr. 10, pp. 517–521 1995.

*Primary Examiner*—Carl D. Price

*Attorney, Agent, or Firm*—Morgan & Finegan, L.L.P.

[57] ABSTRACT

The apparatus consists basically of an atmospheric burner, a combustion chamber, and means for creating a vacuum within the combustion chamber. To provide optimum combustion using different gases from one gas family, means for detecting at least one apparatus temperature and means for controlling the primary air flow according to the temperature detected are provided. Various applications are described wherein the temperature is measured at the surface of a burner diffuser and the primary air is controlled to keep the temperature below a critical value and the flame stable. For improved operation at the ignition stage, the flow rate of the primary air is set at a comparatively low predetermined starting value.

18 Claims, 4 Drawing Sheets

T1
55'
54'
51'
15
17
58'
AP
51"
60
61
15'
18
59
55
G
56
54
52
53
51
14
57
58
19
12
13'
11
10
18'

GAS COMBUSTION APPARATUS AND METHOD FOR CONTROLLING THE SAME

FIELD OF THE INVENTION

This invention relates to gaseous fuel combustion apparatus, and in particular to a method for feeding an apparatus which incorporates a burner of the atmospheric type, and to an apparatus implementing the method.

BACKGROUND OF THE INVENTION

The invention is applicable especially to apparatus with a hyperstoichiometric premix burner, that is wherein air is admixed to the gas inside the burner in larger amounts than the required amount for stoichiometric combustion.

An apparatus with an atmospheric burner is described in Italian Patent Application No. MI92A002510 filed on Nov. 2, 1992 by this Applicant. The apparatus comprises, additionally to the atmospheric burner, a combustion chamber and means for creating a vacuum within the combustion chamber relatively to the nozzle area. The burner has gas outflow nozzles, suction and mixing ducts coaxial with the nozzles, and diffusers communicated to the ducts for delivering the gas/primary air mixture into the combustion chamber. The apparatus further comprises a box-type structure connected to the combustion chamber and enveloping the suction and mixing ducts. That structure has a wall laid across between the nozzles and the ducts, and for each nozzle, an intake opening wherethrough primary air is drawn into the ducts and secondary air intake openings adjacent to the primary air intake opening. The streams of primary air and secondary air through their respective openings flow along parallel directions to each other.

The apparatus just outlined provides for uniform and complete combustion of the gas using extremely simple constructional expedients. However, it may still develop ignition problems, i.e. at the start of its operation, and where instead of the standard gas for which the apparatus is set, a gas prone on flame separation from the same family as said standard gas or a so-called "poor-combustion" gas or a so-called "backfiring" gas from the same family are used. Specifically, the diffuser temperature may occasionally attain a critical danger value, and on some other occasions, the flame may become unstable, resulting in poor combustion of the fuel gas. Such problems are felt the more heavily when the premixing of air to the gas is raised above that required for stoichiometric combustion in order to cut down harmful emissions.

SUMMARY OF THE INVENTION

It is an object of this invention to provide a method and apparatus as defined in the preamble which can obviate the problems mentioned hereinabove.

This object is achieved according to the present invention by a method for controlling air in a gas combustion apparatus incorporating a burner of the atmospheric type, wherein a stream of fuel gas is mixed with a stream of primary air in a suction duct and the resultant mixture is delivered into a combustion chamber via a diffuser and wherein during steady-state operation of the burner, the primary air is conveyed into the suction duct in an amount related to at least one temperature detected in the apparatus.

BRIEF DESCRIPTION OF THE DRAWINGS

The invention can be better understood by having reference to the following description of some exemplary and non-limitative embodiments thereof, in conjunction with the accompanying drawings, where.

DETAILED DESCRIPTION OF SPECIFIC EMBODIMENTS

Figure 1:
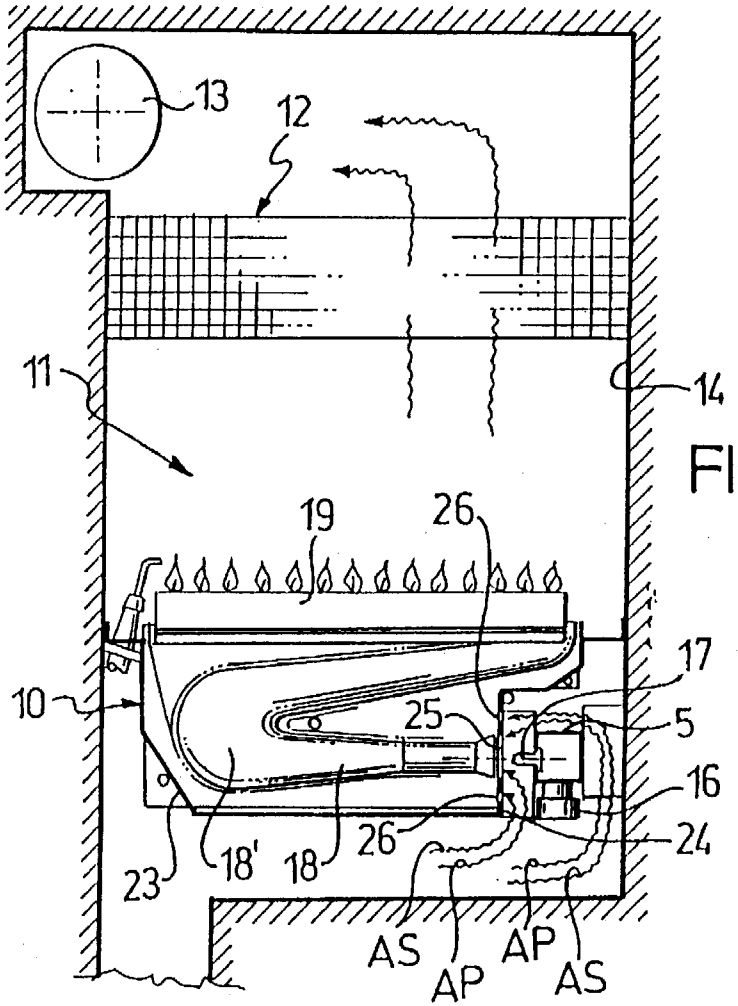
FIG. 1 is a sectional view showing schematically the prior apparatus of the aforementioned patent application.

The apparatus shown in FIG. 1 comprises an atmospheric burner 10, a combustion chamber 11, a heat exchanger 12, and a fan 13, all accommodated inside a compartment 14 which extends vertically in this instance.

Figure 2:
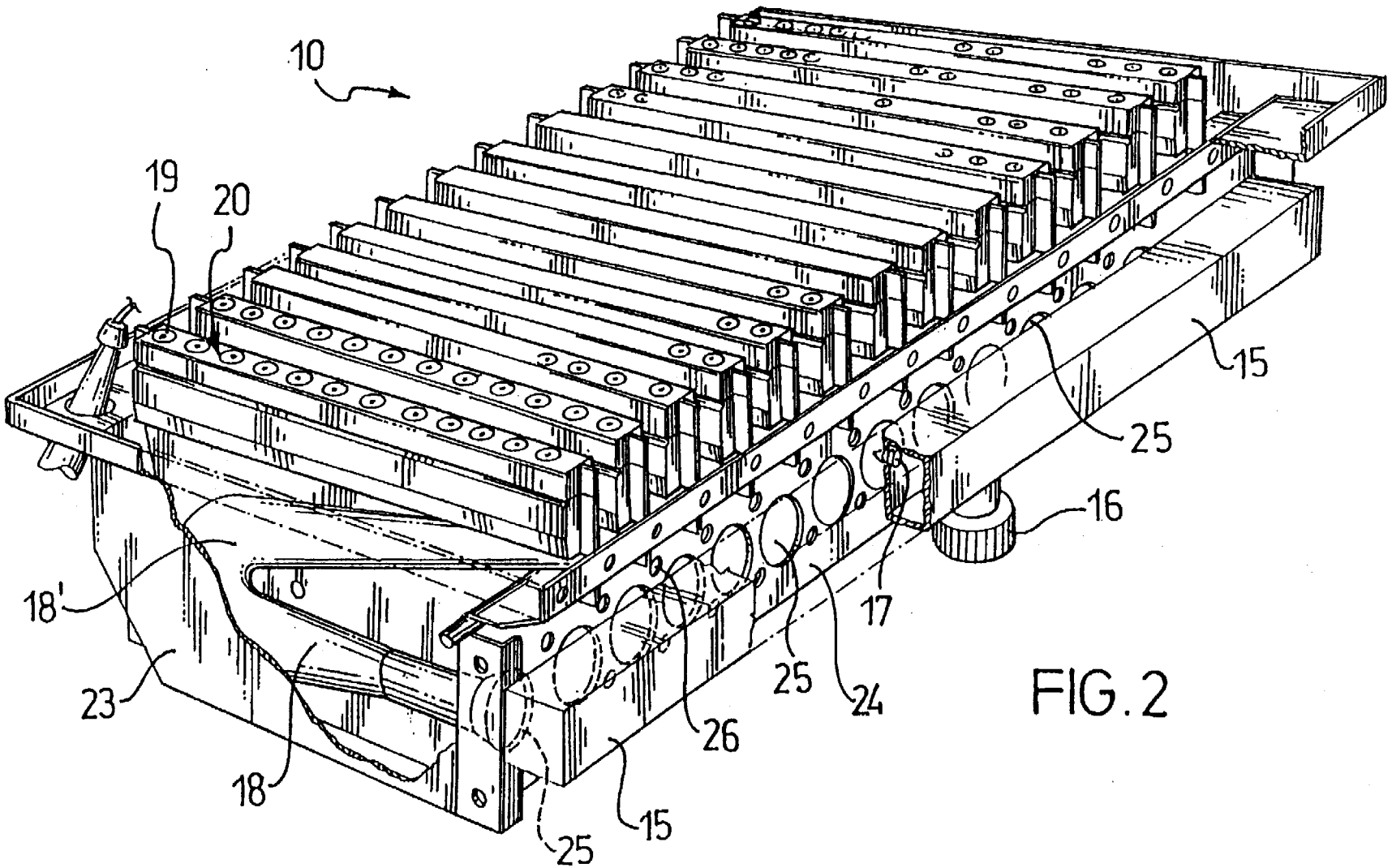
FIG. 2 is an enlarged perspective view of a portion of the apparatus in FIG. 1 incorporating an atmospheric burner.

The burner, as shown best in FIG. 2, comprises a duct 15 having a square cross-sectional shape and being shown with a wall removed, which duct is connected through a fitting 16 to a gas supply and carries a plurality of nozzles 17 which extend from the duct parallel to one another. Associated with each of the nozzles 17 is a duct 18 of metal construction, in the form of a venturi having its inlet end placed a set distance away from the nozzle and, in this instance, coaxial with the nozzle for drawing in primary air and admixing it to the gas outflow from the nozzle. Each venturi 18 directs the gas/primary air mixture, through a connection channel 18', into a diffusing box-type member 19 which has plural openings 20 across its side facing toward the combustion chamber.

The dimensions of the venturis, the openings 25, and more generally all the physical and constructional parameters of the apparatus are selected such that the primary air will be admixed to the fuel gas in varying amounts to suit individual requirements and/or the power output, from values substantially equal to the amounts required for stoichiometric combustion of the gas up to values exceeding these amounts by 50 to 60%.

The venturis 18, their respective connection channels 18', and the diffusers 19 are, as can be seen, arranged in structurally alike sets laid side-by-side some distance apart and with the perforated sides of the diffusers 19 in one plane to form a bed, extending horizontally in this instance, whence the flames will issue.

The bottom portion of the burner 10 is enclosed within a box-type structure 23, shown with a portion thereof removed in FIG. 2, which has its edges matching the walls of the combustion chamber 11 and a wall 24 extending between the nozzles 17 and the venturis transversely of the axes of the latter. This wall is formed, at the location of each nozzle, with a circular opening 25 and some smaller adjacent openings shown at 26. Under the vacuum created by the fan 13 within the combustion chamber 11 with respect to the area of the nozzles 17, primary air AP is drawn into the respective venturis through the openings 25. The additional openings 26 locate outside the areas facing toward the intake ports of the venturis 18, but proximate to the areas where the entraining action is applied to the gas streams issuing from the nozzles 17 and air is accordingly drawn into the venturis. Thus, the secondary air AS can only be drawn into the combustion chamber through said additional openings. The primary air AP and secondary air AS streams, as indicated by arrows in the drawing, flow substantially parallel to each other at the inlet end of the box-type structure 23.

Figures 3A, 3B, 3C:
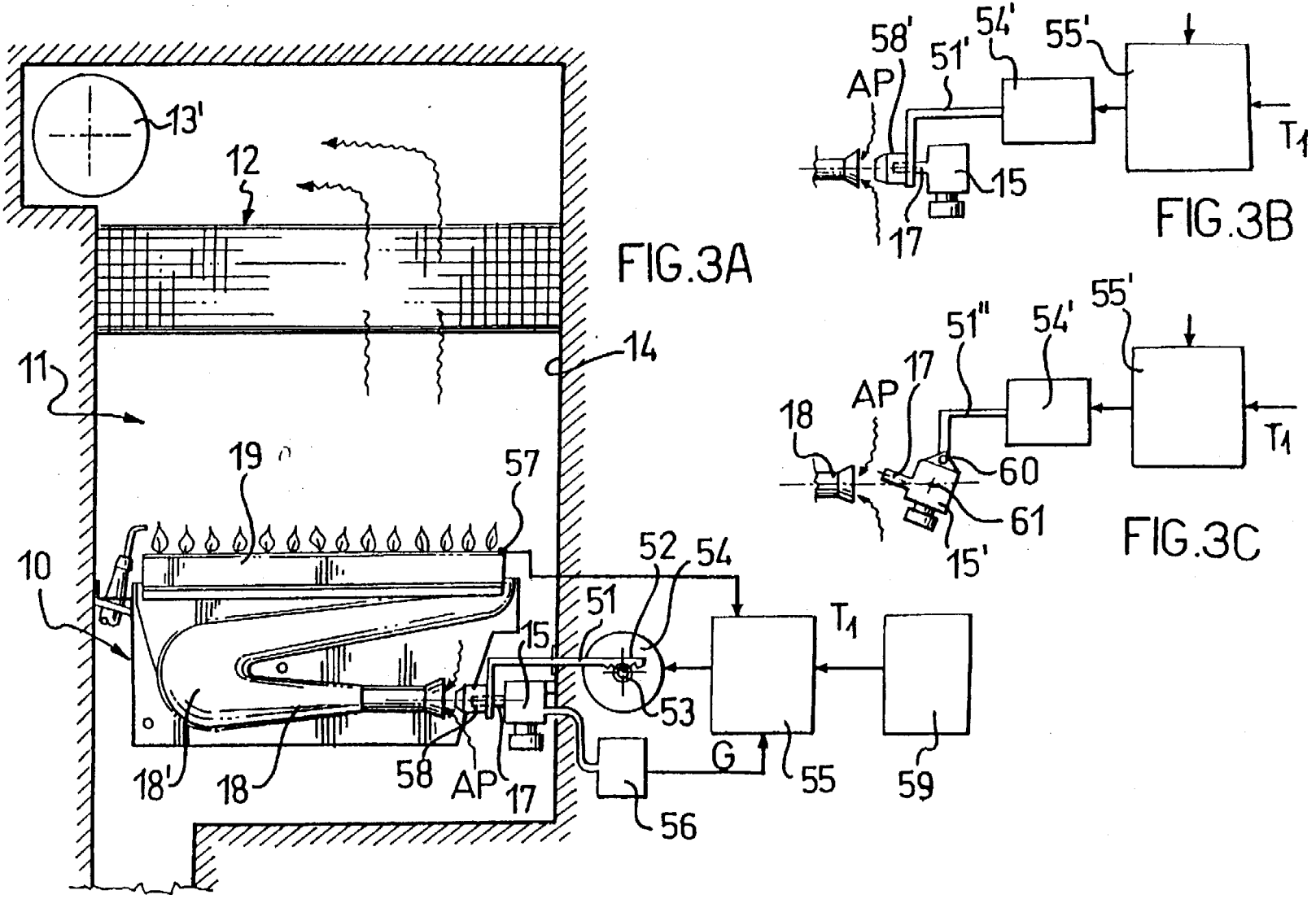
FIGS. 3B and 3C show variations of the apparatus of FIG. 3A.

Shown in FIG. 3A, where similar or corresponding parts to those in FIG. 1 are denoted by the same reference numerals, is an apparatus according to the invention with some of its components generally represented by functional blocks. Shown at 13' therein is the connection to a flue. It is understood, however, that the invention would also apply to an embodiment employing a fan as in the prior apparatus according to FIG. 1.

The burner 10 bottom here is not enclosed within a box-type structure as is that shown at 23 in FIG. 1, but it is understood that the invention could also be applied to burner arrangements providing that structure. Further, the following description will make reference to a burner having a single nozzle 17 and a single venturi associated therewith which is contained in a corresponding box-type diffuser member 19, but it is understood that the burner could be a multiple nozzle burner with corresponding venturis and diffusers, similar to that described in relation to FIG. 1. It will be appreciated, in fact, that the invention may also apply to multiple nozzle embodiments with a few simple adaptations well within the capabilities of the skilled ones.

As can be seen, a sleeve 58 is provided around the nozzle 17 which is slidable over the nozzle by means of a rod 51 which is attached with one end to the sleeve and carries, on the other end, a rack 52 for engagement by a pinion gear 53 keyed to a shaft of an electric motor 54. The latter may be a step motor and is powered through a processing and control unit, generally represented by a block 55. A pressure sensor 56 is connected to the gas supply duct 15 to detect the flow rate of the gas issuing from the nozzle 17 and send a corresponding electric signal, denoted by G, to the unit 55. A temperature sensor 57, such as a thermistor, is mounted on the surface of the diffuser 19, or close to it, and provides a measurement of the temperature detected by the unit 85. The unit 55 is also applied a temperature T1 reference which is set through a control device 59, such as a manually operated preselector.

The steady-state operation of the burner at a predetermined gas flow rate from the nozzle 17 will now be described.

The burner will have been set for ideal operation on a standard gas from a family of fuel gases, e.g. on town gas (pure methane) from the family of "natural" gases. Specifically, the sliding sleeve 58 is moved toward the venturi 18 such that on ignition, by altering the gas jet from the nozzle 17, the amount of primary air AP drawn in will have a comparatively low starting value. In this way, a gas/air mixture is obtained which is favorable to combustion with the burner still cold or on its way to become heated. The reference value for temperature T1 is set to provide optimum combustion of standard gas. For instance, T1 would be set at a value which corresponds to a temperature within the range of 250° to 450° C. at the diffuser surface. The temperature measured is compared continuously with the reference value, and the result of the comparison is used by the unit 55 to generate a control signal to the motor 54. The latter is powered through the unit 55 to drive the sleeve 58 away from the port of the venturi 18 to a position where the flow of primary air AP is appropriate to establish a desired temperature at the diffuser.

When, with these settings of the apparatus, instead of standard gas, a gas is supplied which is prone on flame separation same as the family to which the standard gas belongs, e.g. the gas known as G25, the desired temperature will be attained at the diffuser with a lower primary air flow rate than that required for the standard gas, that is with the sleeve 58 set closer to the port of the venturi 18. Conversely, when instead of standard gas, a poor-combustion gas is supplied such as the gas known as G21, the primary air flow rate will be increased, that is the sleeve 58 moved further away from the port of the venturi 18.

Where instead of standard gas, a gas liable to backfiring is supplied, such as the gas called G22, the primary air flow rate for attaining the desired temperature at the diffuser will be slightly lower than that required for the poor-combustion gas.

The signal G from the pressure sensor 56 is processed by the unit 55 to adjust the control signal applied to the motor 54 in accordance with the flow rate of the gas issuing from the nozzle 17. For many applications, such as with the ON/OFF power control of the apparatus described hereinafter, this adjustment is unimportant and the pressure sensor 56 and processing circuit for the flow rate signal may be omitted.

For certain applications, measuring other temperatures in the apparatus, additionally to that measured on the diffuser or alternatively thereof, may prove useful, such as the temperature inside the combustion chamber. Where several temperature signals are provided, they can be processed by the unit 55 using a predetermined procedure effective to ensure optimum gas combustion under any of the feed conditions by control of the primary air, and optionally of the secondary air. It should be considered, moreover, that even where large passages are provided for the secondary air, the latter may be absent altogether if the intake of primary air is made particularly easy.

Shown in FIG. 3B is a variation of the apparatus according to the invention, wherein the control is of the ON/OFF type rather than continuous. A solenoid, shown at 54', is used here as the actuator whose drive rod 51' is attached to the sleeve 58'. The pressure sensor 56 is not provided in this arrangement, and the processing and control unit is designed to generate a control signal which can have but two values, namely first and second values according to whether the detected temperature is higher or lower, respectively, than the reference temperature T1. At such values, the solenoid is de-energized or energized, respectively, whereby the sleeve 58' will respectively locate in a first position close to the port of the venturi 18 or a second position further away from said port when the detected temperature is lower or higher, respectively, than the predetermined temperature.

In another variation shown in FIG. 3C, the drive rod of the solenoid 54' is connected to the nozzle holding duct 15' pivotally about a pivot pin 60. The duct 15' is not attached fixedly to the apparatus structure as in the arrangements of FIGS. 3A and 3B, but rather in a pivotal fashion about an orthogonal axis to the plane of the sheet, as indicated at 61. In this example, said axis is the longitudinal axis of the duct 15'; however, it may be arranged to lie off-center to alter the primary air flow change according to a predetermined operation criterion.

The adjustment, being also of the ON/OFF type, has for its effect that the nozzle is moved between two stable positions, namely a position where the nozzle 17 has its axis coincident with the axis of the venturi 18 and another position where the axis of the nozzle 17 is shifted by a predetermined angle from the venturi axis. As the persons of skill in the art will recognize, the nozzle off-centering results in decreased flow of the primary air entrained by the gas jet through the venturi, similar to the effect to be obtained with the control shown in FIGS. 3A and 3B. Of course, this method of varying the primary air flow can be also used for a continuous type of control, as described in connection with FIG. 3A. In all events, moreover, a device may be arranged to use the temperature measurement from the sensor 57 to block the gas flow at the nozzle 17 upon the temperature approaching danger values.

Figure 4:
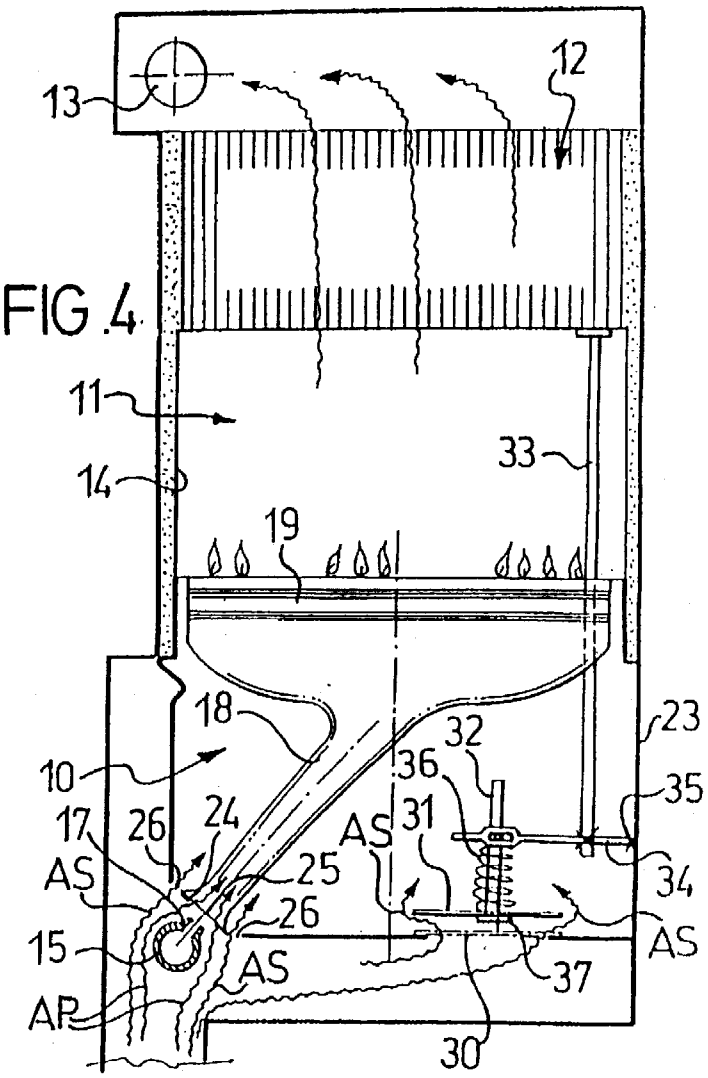
FIGS. 3A, 4, 5 and 6 are sectional views showing schematically an apparatus according to four embodiments of the invention.

In FIG. 4, where similar or corresponding parts to those in FIG. 1 are denoted by the same reference numerals, there is shown an apparatus according to the invention which employs a burner with angled venturis from the horizontal. It is understood, however, that the invention may also be used to advantage with apparatus equipped with burners like that shown in FIG. 1 or any other burner of the atmospheric type having its intake and mixing duct(s) enclosed within a case incorporating the diffuser.

In the embodiment shown in FIG. 4, the bottom wall of the box-type structure 23 has an additional opening 30, a circular one in this instance, and a means of controlling the flow of air through that opening. In this example, said means comprises a closure member in the form of a circular metal plate 31 adapted to overlap the edges of the control opening 30 and being supported centrally on a rod 32, an element responsive to the temperature inside the combustion chamber, in the form of a metal rod 33 penetrating the combustion chamber 14 and part of the box-type structure 23, and actuator members, in this case in the form of a lever 34 pivoted to a point 35 on a bracket attached to the structure 23, connected pivotally both to the end of the rod 33 and the pin 32. The circular plate 31 is slidable upwards along the rod 32 against the bias force of a compression spring 32, and is held down by a ring 37 attached to the rod 32.

The various elements are arranged and sized such that, with the burner turned off, the closure plate 31 will locate some distance off the bottom wall of the box-type structure, thereby allowing an abundant amount of secondary air AS to be drawn through the control opening 30. The large flow of secondary air thus provided results in the flow of primary air being decreased with respect to that provided for steady-state combustion of the standard gas, i.e. of the gas for which the burner is set, so that the pre-mixing rate will be relatively low and no flame separation will occur even when a gas prone on flame separation is used. As the temperature inside the combustion chamber rises and the rod 33 length increases by expansion, the plate 31 is moved down by the lever 34 operated by the rod, thereby reducing the secondary air passage cross-section through the additional opening 30. At a predetermined temperature within the range of 550° to 600° C., for example, the opening 30 is shut off completely, and the flow of secondary air is limited to that going through the openings 26 in the wall 24, that is an optimum flow for thorough combustion of the standard gas in steady-state operation. Any further expansion of the rod 33 would have no effect on the closure plate 31 because the rod 33 is allowed to slide therein against the spring 36.

In operations using gases which are prone on flame separation, even in the steady state the additional opening may be left open partway, if the predetermined temperature is not attained in the combustion chamber with such gases.

In practice, therefore, the use of a gas prone on flame separation will be recognized automatically and the flow rate of primary air adjusted accordingly. Specifically, it will be kept lower than the required flow where the gas is the standard gas.

With the apparatus according to this embodiment of the invention, additionally to obviating the flame separation problem at the ignition stage, especially with a gas prone on flame separation, the ratio of primary air to secondary air can be controlled even during normal combustion, particularly in the modulation instance, when the feed to the burner is cut down to limit the thermal power output. In fact, based on the temperature inside the combustion chamber being inversely proportional to the excess air, compared to the stoichiometric value required for combustion, that is directly proportional to the percent values of $CO_2$, the dimensions and arrangements of the control device elements can be selected such that the expansion of the rod 33, in turn proportional to the combustion chamber temperature, will control the secondary air passage cross-section through the additional opening 30 to ensure the best ratio of primary air to secondary air under any conditions. The most convenient location of the additional opening is, for this purpose, close against the intakes of the venturis.

Figure 5:
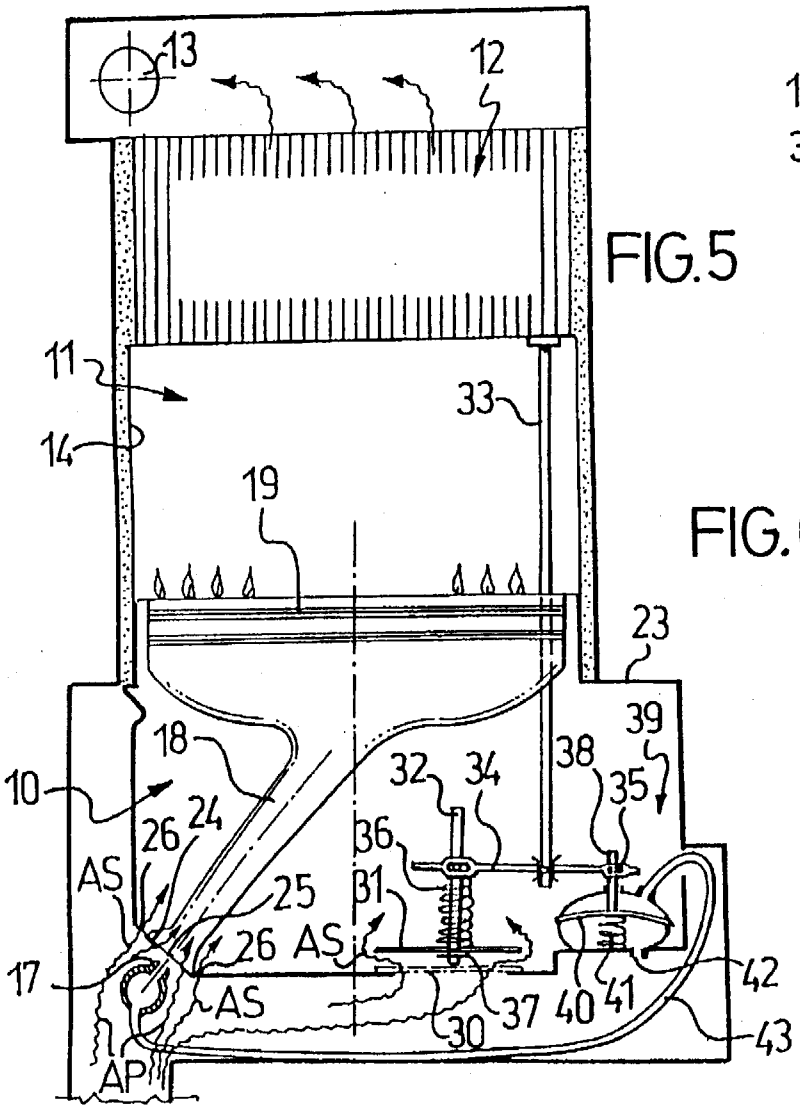

In the embodiment illustrated by FIG. 5, where similar or corresponding elements to those in FIG. 4 are denoted by the same reference numerals, the apparatus differs from the previously described one by that the pivot 35 for the lever 34 is not fixed on the box-type structure 23, but positioned on the rod 38 of a pressure transducer in the form of a diaphragm-operated pressure sensor generally indicated at 39. The rod 38 is rigid with a diaphragm 40 which divides the pressure sensor into two compartments and is loaded by a compression spring 41 in the bottom compartment, which is communicated to the outside through a passageway 42 provided in the wall of the structure 23. The top compartment of the pressure sensor is connected by a pipe 43 to the gas duct 15, so that the gas pressure will act on the diaphragm 40 against the action of the spring 41. Thus, the height of the pivot 35 will depend on the gas pressure within the duct 15, and hence on the gas flow rate to the nozzles, so that the relationship of the combustion chamber temperature to the secondary air passage cross-section through the opening 30 can be altered according to the gas flow rate. Specifically, with the control device shown in FIG. 4, lower flows result in the opening 30 being shut off completely at lower combustion chamber temperatures.

In a variation of this invention, the amount of primary air which is drawn in toward the combustion chamber is controlled by controlling the overall amount of air admitted into the apparatus, e.g. by reducing the vacuum within the combustion chamber with respect to the area of the nozzles. This may be accomplished by either decreasing the speed of the fan 13 in the apparatus shown in FIG. 1, or by shutting a gate in the outgoing smoke path where the apparatus includes a flue, or opening a bypass in the air path.

Figure 6:
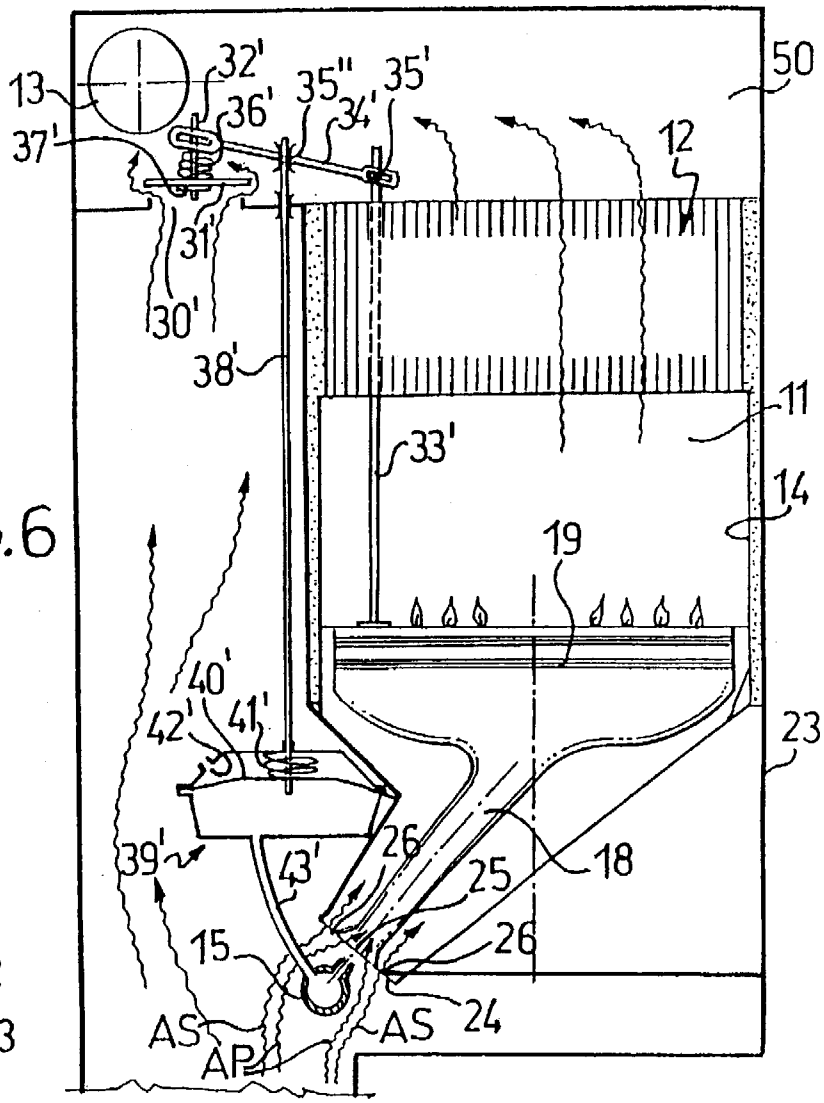

An example of the latter type of control arrangement is shown in the apparatus according to the fourth embodiment of the invention illustrated by FIG. 6, where similar or comparable elements to those in FIG. 4 are denoted by the same reference numerals, with the possible addition of a prime.

As can be seen, the duct, indicated at 50, which directs the exhaust gases to the fan 13 and hence to the apparatus outlet, is provided with an opening 30' having, in this case, a circular shape, which communicates that duct to the apparatus outside, specifically to the duct through which the air for the burner operation is drawn in. A circular metal plate 31' adapted to overlap the edges of the opening 30' and being supported centrally on a rod 32' constitutes a closure member for the opening. A metal rod 33' penetrating the combustion chamber 14 and the heat exchanger 12 constitutes an element responsive to the internal temperature of the combustion chamber and is coupled to the plate 31' by actuator members, in this case in the form of a lever 34'. The circular plate 31' is slidable upwards along the rod 32' against the bias force of a compression spring 36' disposed around the rod 32' and is held down by a ring 37' attached to the rod 32'. The intermediate pivot for the lever 34', indicated at 35", locates on the output rod 38' of diaphragm-operated pressure sensor, generally shown at 39', which is rigid with the box-type structure 23. That rod 38' is rigid with a diaphragm 40' which divides the pressure sensor into two compartments and is loaded by a compression spring 41' in the top compartment, which is communicated to the outside by a passageway 42'. The bottom compartment of the pressure switch is connected by a pipe 43' to the gas duct 15, whereby the gas pressure will act on the diaphragm 40' against the action of the spring 41'. The height of the pivot 35" is, therefore, dependent on the gas pressure within the duct 15, and hence on the gas flow rate to the nozzles. As can be appreciated, the air passage cross-section of the opening 30' controlled according to the combined actions of the rod 33' expansion, and hence the combustion chamber temperature, and the position of the pivot 35", and hence the gas flow rate. The mutual arrangement of the various elements in this embodiment is such that lower flow rates result in the opening 30' being shut off completely at lower combustion chamber temperatures, but in different embodiments, it may prove convenient to control the combined action of the temperature and flow rate detectors otherwise.

Obviously, the effect of having the air passage through the opening 30' controlled is one of changing the vacuum within the combustion chamber 14 with respect to the area of the nozzles. Thus, control of the primary air AP is achieved by controlling the overall flow rate of the intake air to the burner through the vacuum created by the fan 13, and in conclusion optimum combustion control, both at the ignition stage and when using gases prone on flame separation, by controlling the response and mutual action of the element responsive to the combustion chamber temperature and the gas flow rate detector.

CONCLUSIONS

While only a few embodiments of the invention have been described and illustrated, it will be understood that many changes and modifications may be made thereunto within the same inventive concept.

In a variation, for example, the primary is controlled by changing the cross-section of one or more of the openings through which the secondary air is flowed during steady-state operation; that is, no special control opening is provided.

In another variation, the secondary air during steady-state operation is drawn into the box-type structure through one or more openings provided at locations other than those shown in the apparatus of FIGS. 4 to 6.

Also, the temperature responsive elements may be, rather than thermistors or metal rods as in the examples described in the foregoing, thermocouples, bimetallic strips, or some other devices fitted inside the combustion chamber or attached to the diffusers, the flow rate detectors may be, rather than pressure sensors, pitot tubes, hot wire detectors, etc., and the actuator members may be, rather than motors or purely mechanical members, solenoids, wax expansion actuators, bimetallic strip actuators, or else.

We claim:

1. A method for controlling air being supplied to a gas combustion apparatus having an atmospheric burner comprising:

a) introducing fuel gas in a class of fuel gases and a stream of primary air into a suction duct of a burner to form a fuel-gas air mixture;

b) introducing said mixture into a diffuser associated with said burner and forming a flame region above a surface of said burner in a combustion chamber of said combustion apparatus, said primary air being introduced into the suction duct in an amount responsive to at least one temperature detected at or within the flame region of said burner, and in steady-state operation, said amount of primary air varying between a value substantially equal to the amount required for stoichiometric combustion of the fuel gas and a value largely exceeding said amount required for stoichiometric combustion of the fuel as;

setting the burner to provide optimum combustion of said fuel gas, said optimum combustion corresponding to a desired temperature at or within said flame region of said burner; and varying said amount of primary air admixed with said fuel gas to change the ratio of primary air fuel gas to cause said detected temperature to approach said desired temperature.

2. The method according to claim 1, wherein said introducing step includes an ignition stage of the burner operation where the amount of primary air is initially set at a predetermined starting value.

3. The method according to claim 1, further comprising the step of detecting a second temperature within the combustion chamber and controlling the amount of primary air introduced into the combustion apparatus in response thereto.

4. The method according to claim 1, further comprising the step of measuring the fuel gas flow rate and determining the amount of primary air from the value of that fuel gas flow rate measurement.

5. The method according to claim 1, wherein the amount of primary air is set to have a first value or, a second value higher than the first value when said detected temperature is lower or higher, respectively, than said desired temperature.

6. The method according to claim 1, wherein secondary air is introduced into the combustion chamber and the amount of primary air is determined by varying the overall amount of air entering the combustion chamber.

7. A gas combustion apparatus comprising, a combustion chamber having:

1) a burner, said burner including:

at least one gas outflow nozzle, a corresponding number of ducts with intake ports and at least one diffuser, said intake ports confronting respective ones of the nozzles for drawing in a flow of primary air, said at least one diffuser being in flow communication with at least one of said ducts and containing at least one outflow opening for a fuel gas/primary air mixture;

2) a temperature detecting means, said temperature detecting means including a first sensor which is located at a surface of said burner or at least within a flame region of said burner and downstream of said at least one outflow opening for detecting and generating a first temperature signal indicative of the temperature proximate to or at the surface of said at least one diffuser;

3) means for setting the burner to provide optimum combustion of a standard gas of a given family of gases, said optimum combustion corresponding to a desired temperature at the surface of said at least one diffuser;

4) means for varying said flow of primary air in said primary air-fuel gas mixture to change the ratio of primary air and fuel gas to cause said detected temperature to approach said desired temperature at said surface of said at least one diffuser, said flow varying means including means to control the mixture of said primary air with said fuel gas so that the amount of primary air, which, in steady-state operation of the burner, is allowed to vary from a value substantially equal to the amount required for stoichiometric combustion of the fuel gas up to a value exceeding that required for stoichiometric combustion;

5) an exhaust duct for venting gases of combustion; and 6) means for creating a vacuum within the combustion chamber with respect to the area of the nozzle(s).

8. The apparatus according to claim 7, wherein said temperature detecting means further includes a second temperature sensor located downstream of said first temperature sensor.

9. The apparatus according to claim 8, wherein said primary air flow varying means includes a process control unit, said control unit being responsive to said setting means and said desired temperature, said control unit producing and transmitting a primary air control signal which is a function of said first temperature signal and said desired temperature, and an actuator member connected to said process control unit and operative to vary the flow of primary air according to said control signal.

10. The apparatus according to claim 9, wherein said process control unit also receives said first signal and generates said control signal in response to said first signal.

11. The apparatus according to claim 7, further comprising:

7) means for detecting the flow rate of the gas mixture issuing from said at least one outflow nozzle and generating a first signal representative of said gas mixture flow rate; and wherein said means for varying the flow of primary air includes means for varying said primary air flow in response to said first signal.

12. The apparatus according to claim 11, wherein means for said primary air flow varying means are operatively coupled to said means for creating a vacuum.

13. The apparatus according to claim 11, wherein the means for varying the flow of primary air includes a process control unit responsive to said setting means and said desired temperature, said control unit producing and transmitting a primary air control signal which is a function of said first temperature signal and said desired temperature, and actuator mean connected to said process control unit and operative to vary the flow of primary air according to said primary air control signal.

14. An apparatus according to claim 13, wherein the actuator member comprises means for shifting the axis of the nozzle, or the axis of at least some of the nozzles, relative to the axis of the respective primary air suction duct.

15. The apparatus according to claim 13, wherein said control unit provides said control signal which is a first value or a second value when said detected temperature is lower or higher, respectively, than said desired temperature, and said actuator member sets the flow rate of primary air at a first predetermined value or a second pre-determined value higher than the first predetermined value, correspondingly with the first value or second value, respectively, of the control signal.

16. The apparatus according to claim 13, wherein said process control unit also receives said first signal and generates said control signal in response to said first signal.

17. The apparatus according to claim 13, wherein said actuator includes means for controlling the flow of primary air through said at least one duct.

18. The apparatus according to claim 13, wherein said actuator includes a slidable sleeve which is axially slidable over said at least one nozzle.

* * * * *